United States Patent [19]

Craxton

[11] Patent Number: 4,574,527

[45] Date of Patent: Mar. 11, 1986

[54] TORIC LENS GENERATING

[76] Inventor: Robert S. Craxton, 7 Alvin Pl., Rochester, N.Y. 14607

[21] Appl. No.: 658,343

[22] Filed: Oct. 5, 1984

[51] Int. Cl.[4] ..... B24B 13/00

[52] U.S. Cl. ..... 51/33 W; 51/55; 51/284 R; 51/165.71

[58] Field of Search ..... 51/33 W, 55, 284 R, 51/165.71

[56] References Cited

U.S. PATENT DOCUMENTS

| | | | |
|---|---|---|---|
| 2,548,418 | 4/1951 | Bernheim et al. . | |
| 2,633,675 | 4/1953 | Ellis . | |
| 2,724,218 | 11/1955 | Dillon et al. . | |
| 2,806,327 | 9/1957 | Coburn . | |
| 3,117,396 | 1/1964 | Dalton . | |
| 3,289,355 | 12/1966 | Coburn et al. . | |
| 3,492,764 | 2/1970 | Dalton . | |
| 3,624,969 | 12/1971 | Dalton . | |
| 3,685,210 | 8/1972 | Bowen | 51/33 W |
| 3,790,875 | 2/1974 | Craxton | 318/573 |
| 4,068,413 | 1/1978 | Suddarth | 51/55 |
| 4,264,249 | 4/1981 | Dawson . | |
| 4,271,636 | 6/1981 | Hamilton . | |
| 4,434,581 | 3/1984 | Spriggs | 51/284 R |

*Primary Examiner*—Harold D. Whitehead

*Attorney, Agent, or Firm*—M. Lukacher

[57] ABSTRACT

Elliptical error in the generating of toric lenses is substantially eliminated, thereby reducing the time and cost of the production of such lenses. A cup-shaped cutter wheel is swept to cut the lens in a plurality of cuts, suitably three cuts. During each cut the inclination of the cutter wheel and its displacement from the lens in a direction along the optical axis of the lens are changed. Each subsequent cut reduces the elliptical error left after the preceding cut. A computer controller, including a memory storing a table of values of angular orientations and displacements of the cutter wheel with respect to the lens for each of a series of cross curve powers ($D_C$) which is desired to accompany each of a series of base curve powers ($D_B$), is used to control the positioning of the cutter unit mounted on the headstock and the tailstock on which the lens is mounted for cutting so as to cut both convex (plus) and concave (minus) toric lenses with minimal elliptical error in the cross curve thereof.

12 Claims, 18 Drawing Figures

$P_- = (x_{P-}, 0, z_{P-})$ $x_{P-} = (R_B - r_N) \cos\theta$ $z_{P-} = -(R_B - R_C) \sin\theta$

TORIC LENS GENERATING

DESCRIPTION

The present invention relates to methods and apparatus for generating toric surfaces, and particularly for grinding of ophthalmic lenses having toric surfaces.

The invention has as its principal object to provide improved methods and apparatus for the control of toric lens cutting machines which utilize cup-shaped cutter wheels. Such wheels are rotated or swept about an axis perpendicular to the lens axis. The curve generated in the plane perpendicular to the sweep axis, known herein as the base curve, and whether the lens is concave or convex, are determined by the location of the sweep axis with respect to the lens (forward of the lens for a concave lens and to the rear of the lens for a convex lens). The base curve, as is desired for a true toric surface, is an arc of a circle whose curvature is determined by the distance between the sweep axis and the center of the lens surface. The curve in the direction orthogonal to the base curve, or equivalently in the direction parallel to the sweep axis, is known herein as the cross curve. The angle of orientation of the cutter wheel determines the power of the cross curve. Such cross curves, for reasons inherent in the geometry of the grinding machine, are generated with errors commonly known as "elliptical errors". The cross curve which is cut deviates from the true circular arc which is ideally desired. The cross curve is closer in shape to an elliptical arc than to a circular one, but its actual shape is in fact more complicated than an elliptical arc. The invention provides methods and apparatus whereby toric lenses can be cut on such grinding machines with cup-shaped cutter wheels at high speed and at low cost. Since the elliptical error is substantially removed during the initial cutting of the lens, the time and equipment necessary for subsequent smoothing and polishing is reduced, thereby lowering the cost of production of toric lenses. While the invention is especially suitable for ophthalmic lens grinding purposes, it may also be applied wherever the generation of toric surfaces is called for.

The terms "base" and "cross" curve used herein differ from the terminology commonly used in the ophthalmic industry where the cross and base curves are, respectively, the curves with smaller and larger radius. The terminology is, however, identical for minus surfaces cut in accordance with this invention.

Toric lens grinding machines which utilize cup-shaped cutter wheels have been in use for some time. Such machines and their operation are described in U.S. Pat. Nos. 2,548,418 issued Apr. 10, 1951, 2,633,675 issued Apr. 7, 1953, 2,724,218 issued Nov. 22, 1955, 2,806,327 issued Sept. 17, 1957, 3,289,355 issued Dec. 12, 1966, 3,492,764 issued Feb. 2, 1970, 3,624,969 issued Dec. 7, 1971, and 3,790,875 issued Feb. 5, 1974. Digital controls for such machines are described in the above-mentioned U.S. Pat. No. 3,790,875. This patent also mentions the known technique of adjusting for elliptical error by the use of a "correction factor", i.e. a correction is made in the angular orientation of the cutter wheel to obtain a cross curve lens power ($D_C$) which is incremented as a function of the difference between the cross curve and base curve powers by an amount equal to $f(D_B-D_C)$ where f is a positive number. The selection of a suitable value of f is determined by trial and error and depends upon the experience of the manufacturing optician. Sometimes, especially when there is a large difference between $D_C$ and $D_B$, the elliptical error is large enough to cause lens fracture in the subsequent smoothing stage. Sometimes several sweeps of the cutter wheel unit are used, with the lens progressively moved along its optic axis towards the cutter, in order not to remove excessive material during each cut. In U.S. Pat. No. 3,685,210, issued Aug. 22, 1972, the tail stock and the lens are backed off from the cutter during the first of two sweeps in order to reduce the risk of lens breakage. However, only the final cut affects the shape of the curve which is generated, and this shape contains elliptical errors which can only be partially compensated for by the above-mentioned correction factor.

The elliptical error problem in the generation of toric lenses is discussed in the above-mentioned U.S. Pat. No. 2,633,675. A machine is described in which the elliptical error is eliminated by oscillating the lens relative to the cutter such that the center of the lens surface being cut is moved back and forth in a vertical plane on a circular arc possessing the desired cross curve radius while the cup-shaped cutter wheel is swept across the lens. Another attempt to eliminate elliptical error is discussed in the above-mentioned U.S. Pat. Nos. 3,492,764 and 3,624,969, in which it is proposed to revolve the lens relative to the cup-shaped cutter wheel while the lens is simultaneously swept through the base curve. Both of these schemes, however, involve the use of complex and cumbersome machinery. A third approach, described in U.S. Pat. No. 3,117,396 issued Jan. 14, 1964 proposes the elimination of the problem by the use of a large number of cutter wheels which do not have a conventional cup-shaped cutting surface, but instead are shaped so that they supposedly cut an exact (circular) cross curve without elliptical error and without adversely affecting the base curve. However a large collection of cutter wheels is needed, which must be frequently dressed and maintained in order to accomplish the purpose of doing away with elliptical error.

Two alternative approaches to generating true toric surfaces involve different types of cutting tool. In U.S. Pat. No. 4,264,249 issued Apr. 28, 1981, use is made of a cutting tool with a single cutting point which can be rotated rapidly along the circumference of a circle of radius equal to the desired cross curve radius while the lens is swept relative to the cutter along the base curve. In U.S. Pat. No. 4,271,636 issued June 9, 1981, a disc-shaped cutter wheel having a narrow or sharp cutting edge is used. The cutting point of the cutter wheel is constrained to move relative to the lens on a true toric surface, so that by sweeping this point back and forth across the lens a multiplicity of times an accurate toric surface may be generated. However, since the shape of the cutting tool presented to the lens is a poor approximation to the shape of the desired toric curve (usually its curvature is greatly in excess of the desired cross curvature), only a small portion of the tool in the vicinity of the cutting point performs useful cutting, necessitating a large number of sweeps to complete the initial grinding of the lens. The major drawback of this approach is therefore the long period of time required to cut a lens.

It is a feature of the present invention to provide improved methods and apparatus for generating toric surfaces, and particularly toric lenses, at low cost and with machines and cutting tools which are already in use.

It is a still further object of the present invention to provide an improved method and apparatus for generating toric lenses and toric surfaces in which elliptical error in the cross curve is minimized, even though the toric surface is generated rapidly using only a few sweeps of the generating tool across the surface being shaped.

It is another object of the present invention to provide improved toric surface and lens generating methods and apparatus which can be carried out and operated under computer control with minimum operator attention and involving the use of relatively unskilled operators.

Briefly described, the invention provides for the generation of toric surfaces and particularly of a lens having a toric surface with base and cross curvatures of different radii. A cutter unit having a cutter wheel, which rotates about an axis perpendicular to the axis of the lens, and preferably a cup-shaped cutter wheel, is used. These rotations are referred to as sweeps. A plurality of such sweeps is used to make a plurality of cuts. The location of the cutter wheel with respect to the lens and the orientation of the cutter wheel are changed prior to each cut in the cuts made during sweeps subsequent to the initial cut, the elliptical error in different portions of the cross curve being thereby reduced. This provides a toric surface in which the elliptical error is minimized with a few cuts and without cutting into the surface of the lens which would introduce errors or require additional smoothing to achieve the requisite toric surface.

The foregoing and other objects, features and advantages of the invention, as well as the presently preferred embodiment thereof and the best mode now known for practicing the invention, will become more apparent from a reading of the following description in connection with the accompanying drawings in which.

Figure 5:
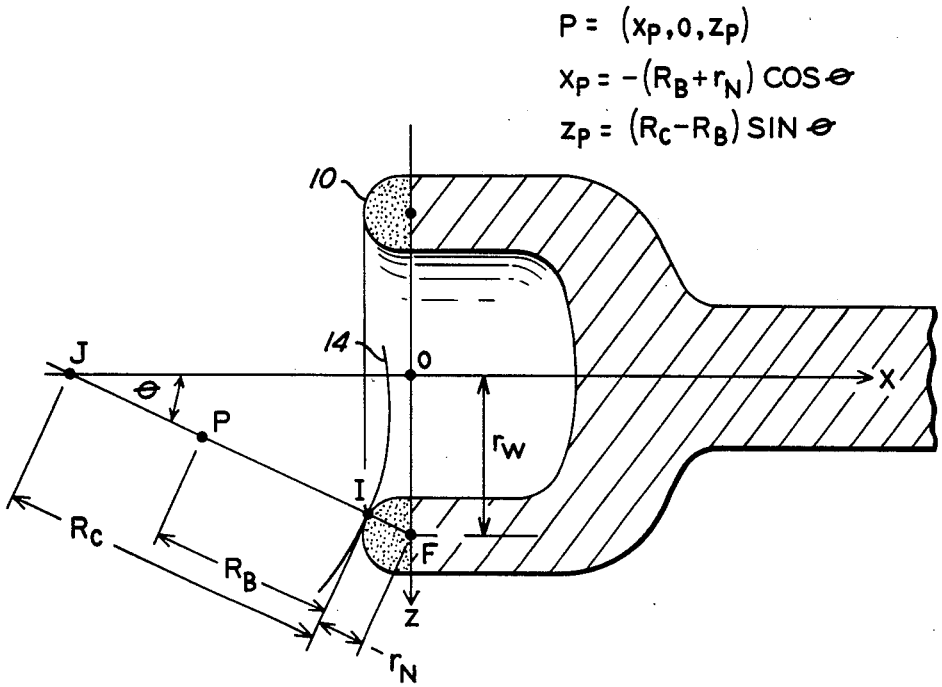
FIG. 5 is a cross-sectional view of the cutter wheel shown in FIG. 1; the section being taken in the horizontal plane through the horizontal meridian of the lens with the tool and its vertical rotational or sweep axis positioned for the generation of a convex or plus lens.
Figure 7:
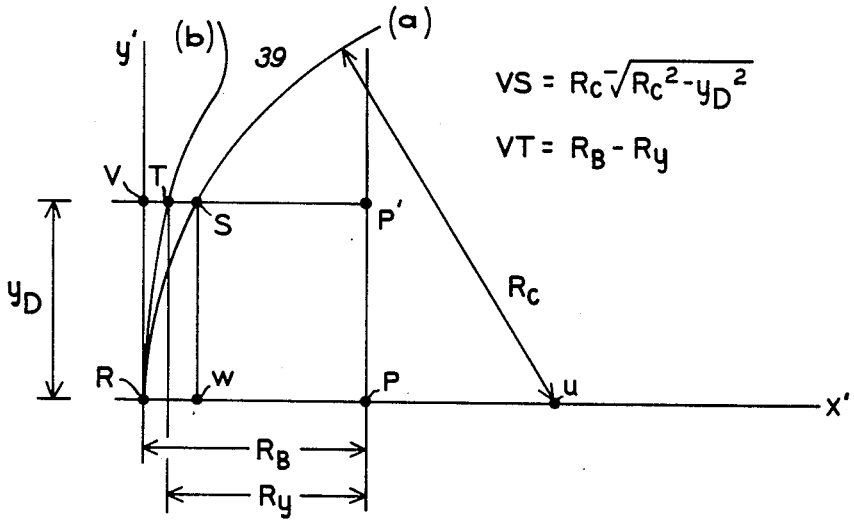
FIG. 7 is a diagram illustrating the cross curve which is desired (curve(a)) and the cross curve obtained (curve (b)), in a vertical section through the center of a convex (i.e. plus) lens with the cutter angle $\theta$ set to cut the cross curve of desired power at the horizontal meridian of the lens and thereby illustrating the elliptical error.
Figure 8:
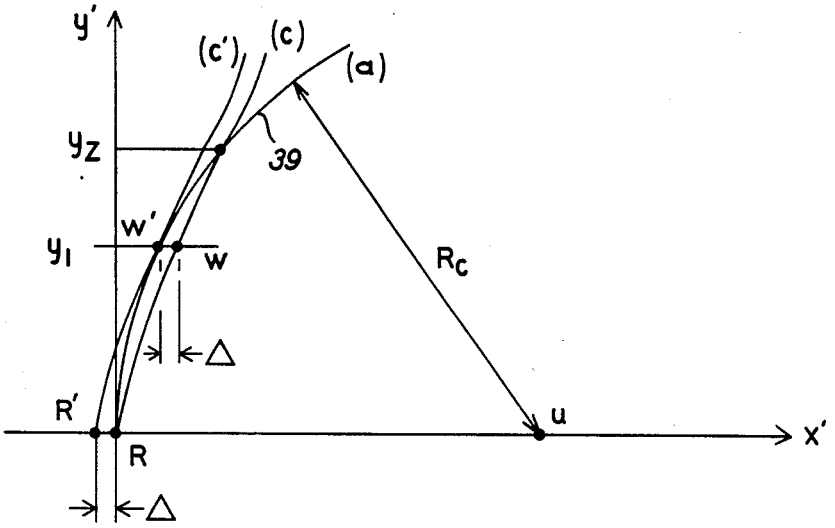
Figure 11:
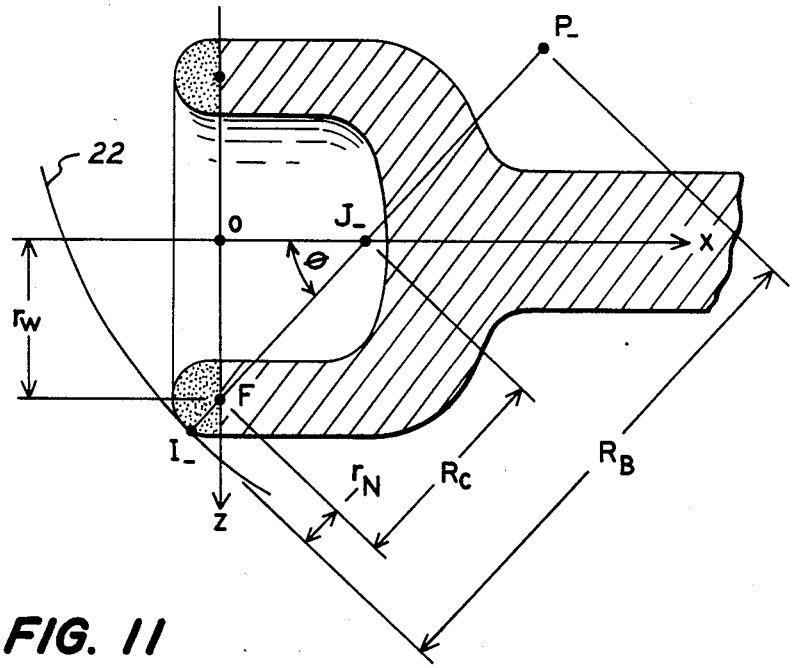
Figure 9:
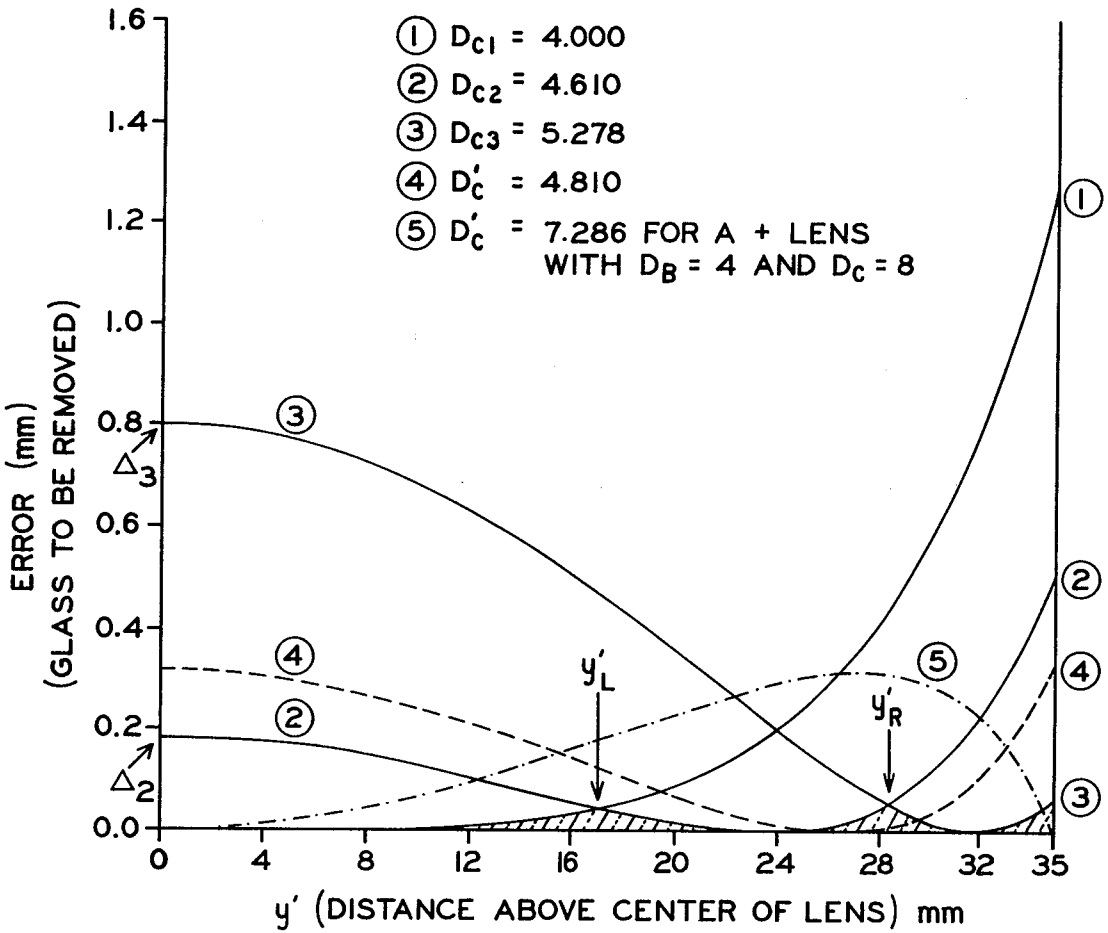
Figure 9A:
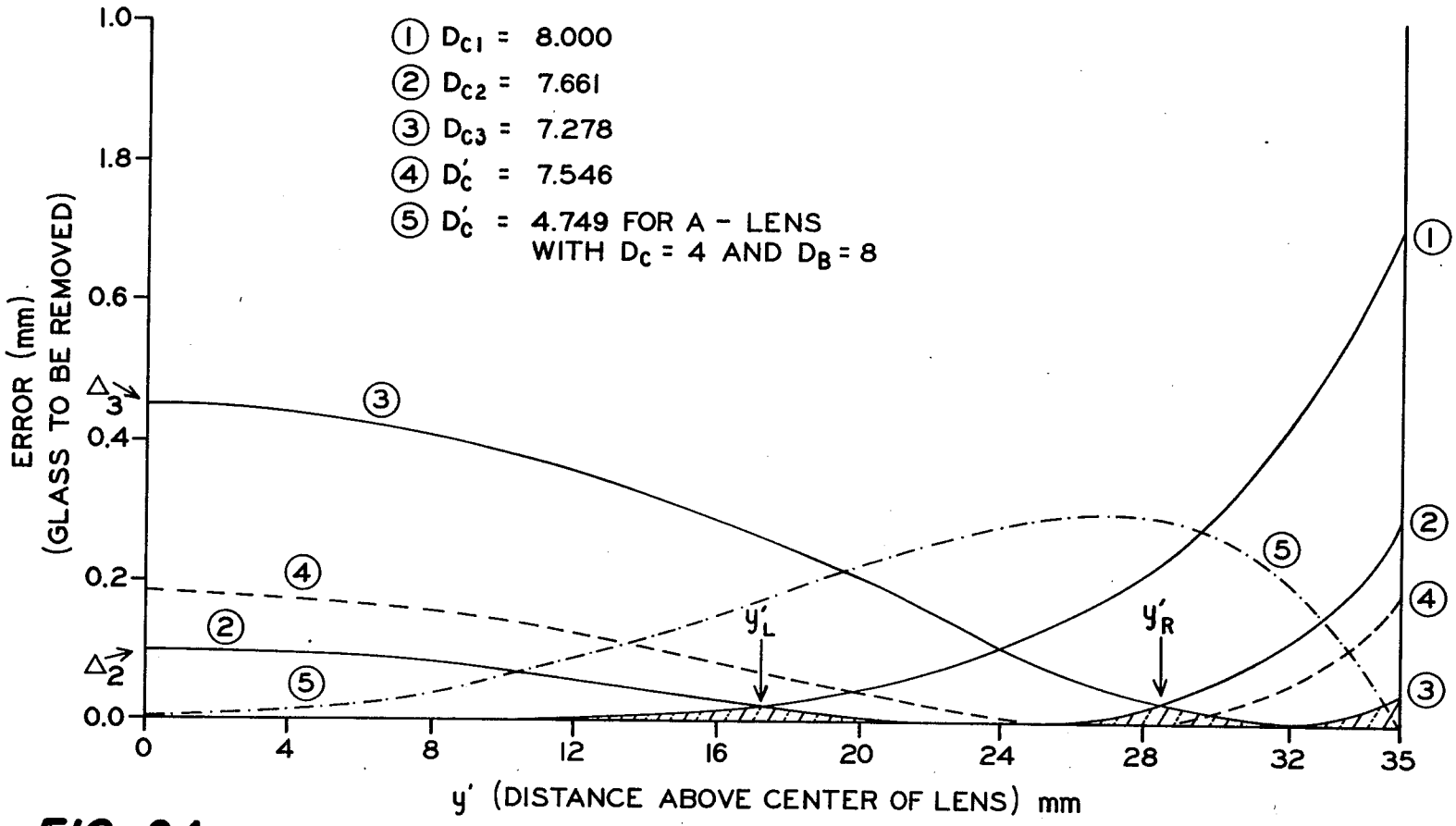
Figure 10:
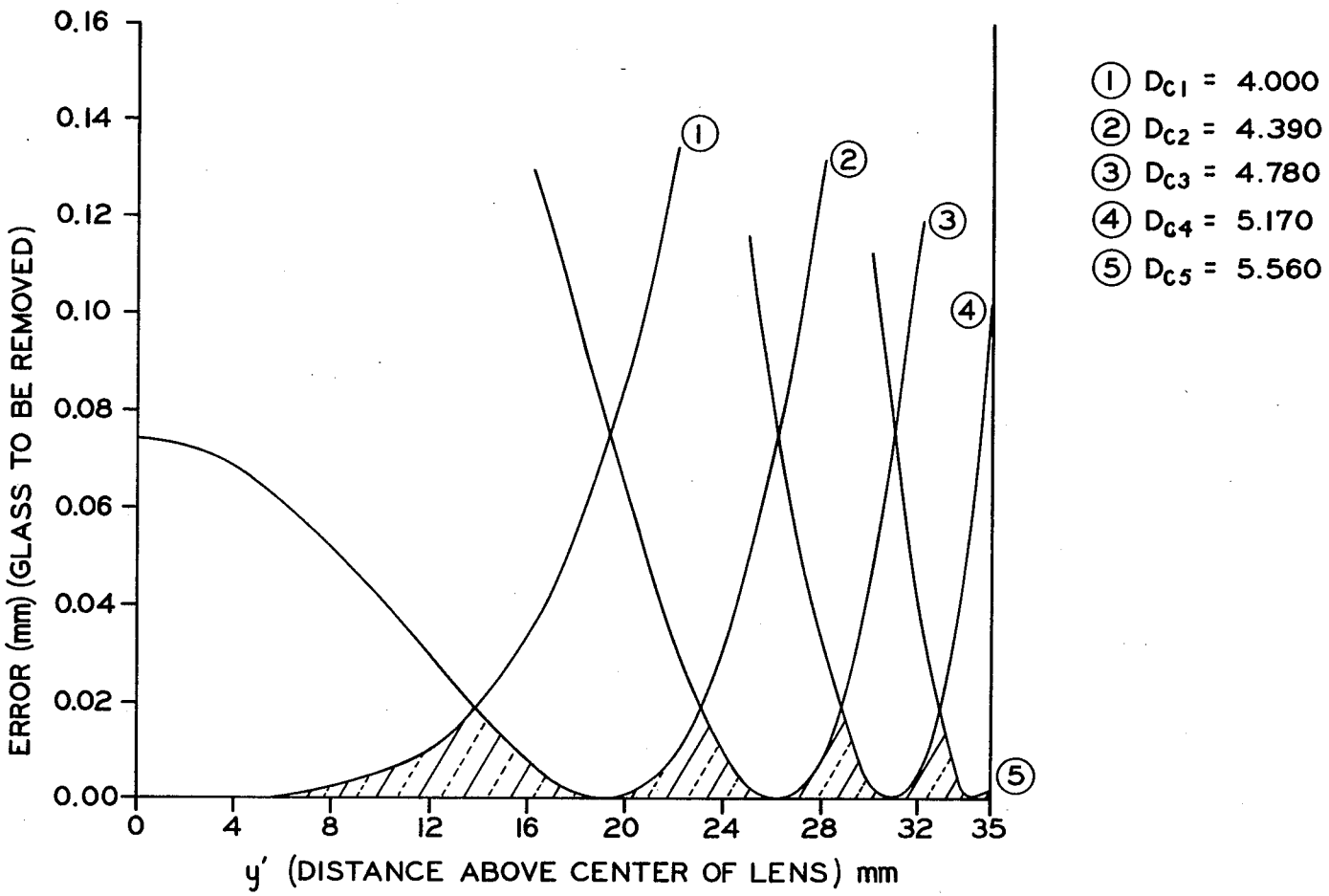
Figure 12A:
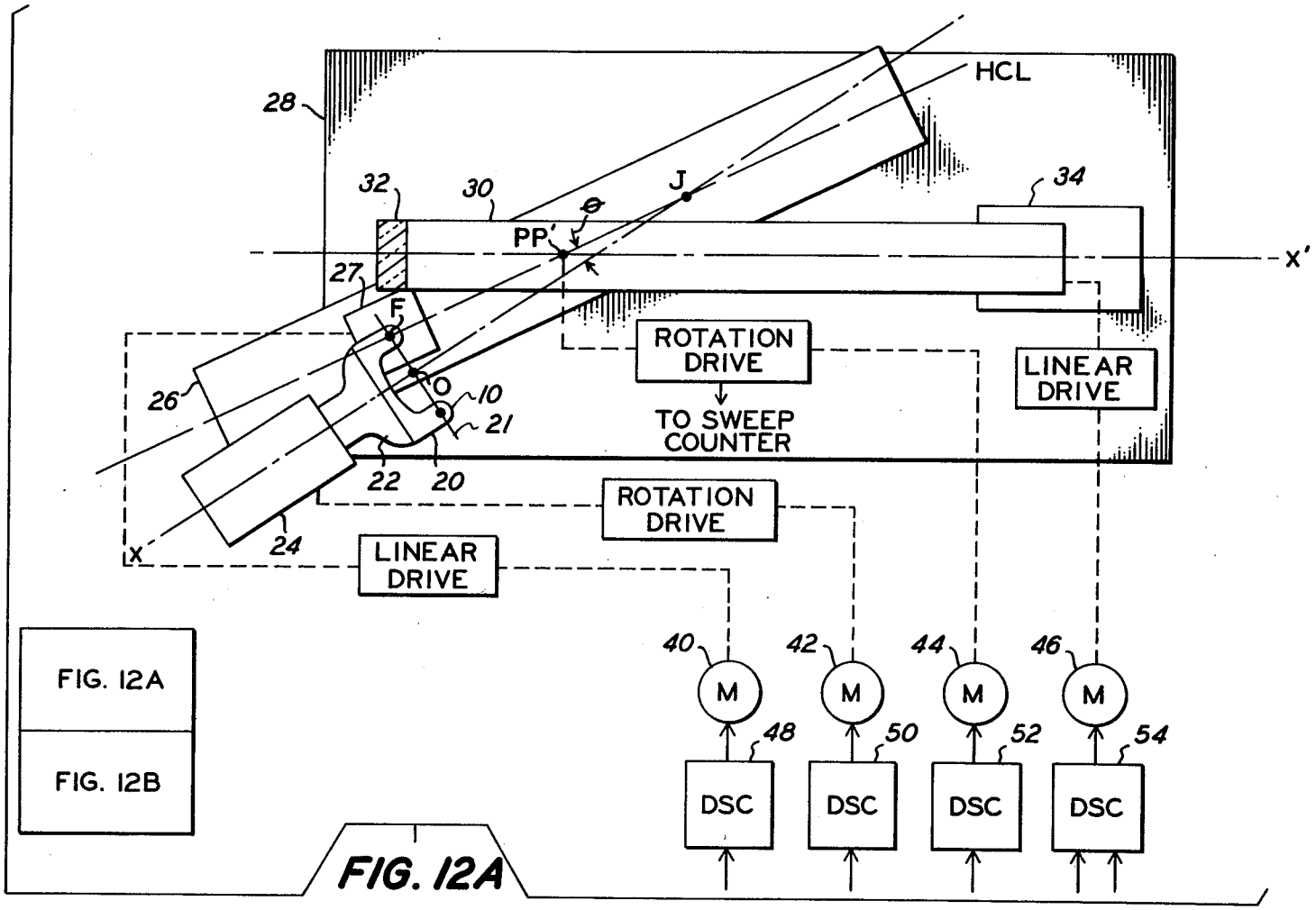
Figure 12B:
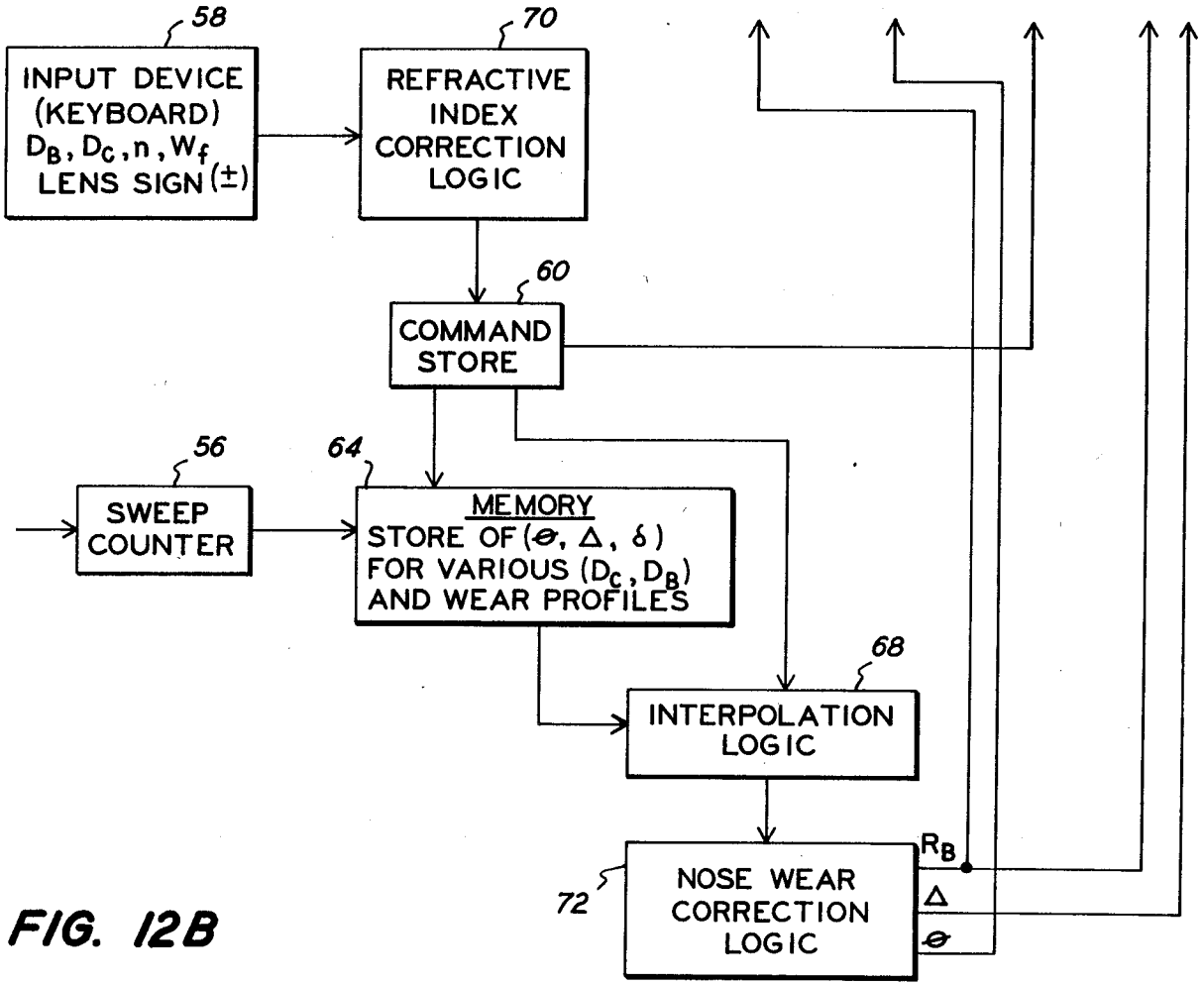
Figure 13:
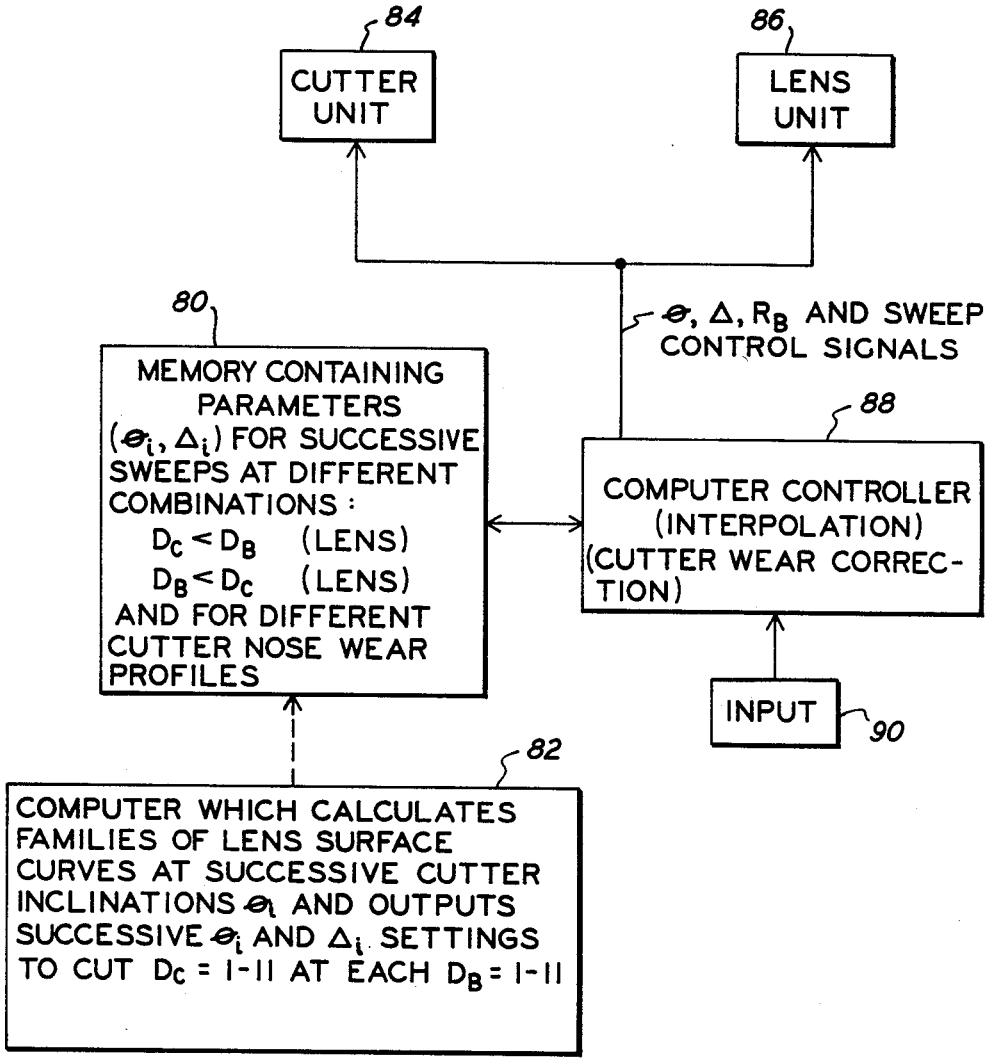
Figure 14:
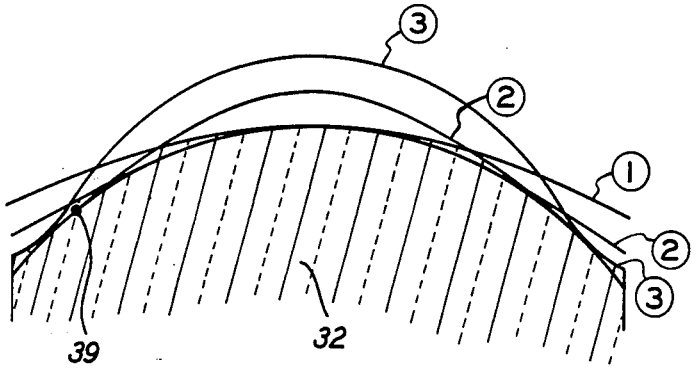
Figure 15:
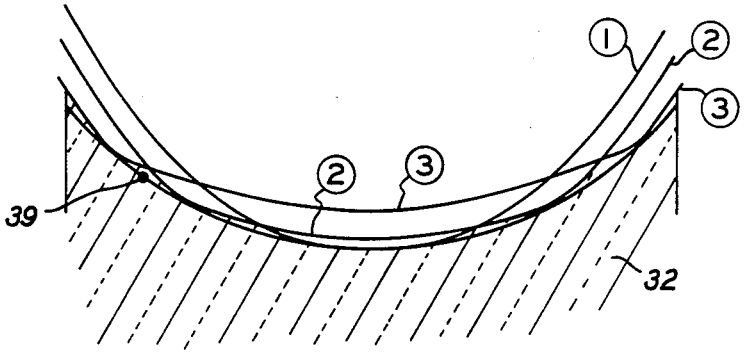

FIG. 8 is a diagram similar to FIG. 7 which illustrates in curve (a) the desired cross curve, in curve (c) the cross curve obtained with an adjusted cutter angle; and in curve (c') the cross curve obtained with the same adjusted cutter angle as in curve (c) but additionally with the displacement between the lens and the cutter being increased by a distance $\Delta$ from the cutter (the lens being retracted along the optical axis);

FIG. 9 is a family of curves illustrating the cross curve error (i.e., the thickness of glass to be removed) as a function of the distance above the center of the lens for a convex lens having the exemplary base curve power $D_B$ equal to 8 and cross curve power $D_C$ equal to 4 for different angles of orientation $\theta$ and different displacements $\Delta$;

FIG. 9A is a family of curves illustrating the cross curve error (i.e. the thickness of glass to be removed) as a function of the distance above the center of the lens for a concave lens having the exemplary base curve power $D_B$ equal to 4 and cross curve power $D_C$ equal to 8 for different angles of orientation $\theta$ and different displacements $\Delta$;

FIG. 10 is a series of curves illustrating the cross curve error as a function of distance above the center of the lens for a convex lens having base power $D_B$ equal to 8 and cross curve power $D_C$ equal to 4 where the cross curve is cut with five sweeps at five different angles of inclination;

FIG. 11 is a cross-sectional view similar to FIG. 5 of a cup-shaped cutter wheel with its vertical rotation (sweep) axis positioned for the generation of a concave or minus lens;

FIGS. 12A and 12B, together are a block diagram illustrating a lens grinding machine positioned for the grinding of a plus lens (the machine being similar to that described in U.S. Pat. No. 3,790,875 referenced above) and a block diagram of apparatus for controlling the machine in a manner to eliminate elliptical error in the toric lenses which are cut therein;

FIG. 13 is a simplified block diagram of a computer controlled toric lens cutting machine embodying the invention;

FIG. 14 is a schematic drawing of a convex surface cut with the sweeps labeled 1–3 in FIG. 9; and FIG. 15 is a schematic drawing of a concave surface cut with the sweeps labeled 1–3 in FIG. 9A.

Referring first to FIG. 12 there is shown a cup-shaped cutter wheel 20 having a nose 10. The cutter wheel is mounted on a spindle 22 which is rotated about the axis of the wheel, indicated as the x axis in FIG. 12, by a motor 24. The cutter wheel 20, its spindle 22 and motor 24 constitute the cutter unit or cutter assembly. This unit is mounted, as explained in greater detail in the above-referenced patent, on a headslide 27 which can slide along a headstock 26 so that the center F of the nose remains on the headstock center line HCL.

The headstock is pivotally mounted on the machine base 28 for rotation about a vertical axis PP'. This axis PP' is along the center line of a tailstock 30 on which the lens to be cut (shown in the form of a lens blank 32) is mounted. The center line of the tailstock is the optical axis x' of the lens. The tailstock 30 is mounted in a tailstock slide 34. It will be appreciated that the apparatus so far described is viewed from the top and the various center lines lie in a plane perpendicular to the rotation or sweep axis PP' and through the meridian of the lens 32.

Although the tailstock 30 is shown as being stationary while the cutting unit rotates about the axis PP', it will be appreciated that the tool may be stationary and the lens rotated about the axis PP'; however the use of a rotating tool is conventional and is preferred. Further information respecting the design of the toric lens grinding machine, so far as its cutting tool assembly, headstock, tailstock and mechanisms for adjusting and rotating same are concerned, will be found in the above-referenced U.S. Pat. No. 3,790,875. The positions of the sweep axis PP' and the cutting unit are shown for the cutting of convex or plus lenses. The positions of these units and the axis PP' for the cutting of concave or negative lenses will be apparent from the above-referenced U.S. Pat. No. 3,790,875.

Motors 40, 42, 44 and 46 are used to actuate the components of the cutting machine. The motors are typically stepper motors. Motor 44 is connected through a rotation drive such as a gear box to the shaft which rotates the headstock 26 about the sweep axis PP'. The motor 40 has an output through a linear drive (e.g., a lead screw) to translate the cutter unit along the headstock center line HCL. The motor 42 has an output through a rotation drive, such as a gear box, to tilt or incline the cutter unit x axis with respect to the headstock center line. This center line passes through the sweep axis PP' and the center F of the nose 10. It will be observed that the nose is semicircular in cross section and is a half torus of major radius from O to F; O being the intersection of the base line 21 through the center F of the nose 10 and the axis of rotation x of the cutter wheel 20. The tailstock 30 is driven by the stepper motor 46 through a linear drive, such as a lead screw.

Digital to step converters (DSC) 48, 50, 52 and 54 translate control signals from digital circuitry which sets the angle of inclination $\theta$ and moves the tailstock 30 so as to displace the lens by distances $\Delta$ prior to successive sweeps.

Figure 5A:
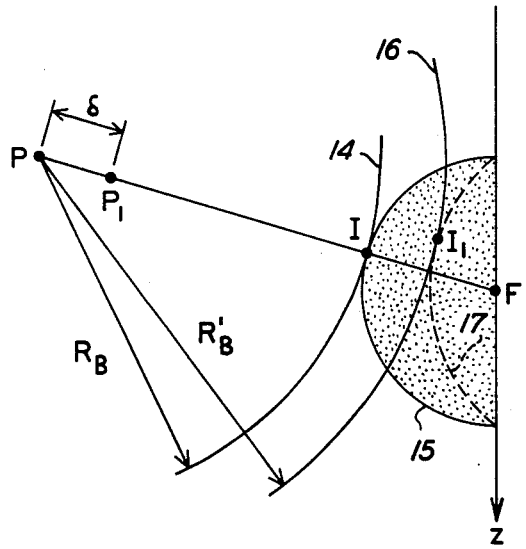
FIG. 5A is a view of the cutter wheel similar to FIG. 5 but with the nose enlarged to show a worn nose.

An output is obtained from the rotation drive to the headstock 26, which sweeps the headstock about the vertical axis PP', to a sweep counter 56. An input device 58, such as a keyboard, inputs the values of the base curve power $D_B$, the cross curve power $D_C$, the refractive index of the lens n, the sign of the lens, and a wear factor $W_f$ to a command store 60. However, before being stored in the command store 60, the input values of $D_B$ and $D_C$ are adjusted by refractive index correction logic 70 to correspond to a reference refractive index $n_0$ (e.g. 1.523). This enables the machine to operate with lens materials having various refractive indices. The command store has memory for the digital signals for each of the commands and applies them to address a memory 64 which stores digital signals corresponding to different orientation angles $\theta$ and different displacements $\Delta$ for a range of values of base curve power $D_B$ and cross curve power $D_C$. There are also stored adjustment values $\delta$ corresponding to the nose wear factor as discussed hereinafter, especially with reference to FIG. 5A. There may, for example, be eleven base curve powers and eleven cross curve powers 1 through 11 and three values of $\theta$ and $\Delta$ for each combination of $D_C$ and $D_B$ to set the location of the cutting tool during each of three sweeps which will generate the toric lens surface while minimizing elliptical error. The values of $\theta$ and $\Delta$ which are used are selected, depending upon which of the three sweeps is to be carried out, by means of the sweep counter 56. In the event that different powers, intermediate to the powers at which values of $\theta$ and $\Delta$ are stored in the memory 64, are held in the command store 60, interpolation logic 68 is used.

The interpolation logic carries out conventional bilinear interpolation to obtain values of $\theta$ and $\Delta$ which are weighted in accordance with the proximity of the selected intermediate values ($D_C$, $D_B$) from the closest points ($D_C$, $D_B$) thereto at which the values of $\theta$ and $\Delta$ are stored in the memory 64.

To correct for wear of the nose 10 of the cutter wheel 20, different angles of inclination $\theta$ and displacements $\Delta$ are required. Then the outputs from the store 64 are passed through nose wear correction logic 72. The output of the logic 72, which like the logic components 68 and 70 interposes no correction or interpolation if none is required, produces digital signals corresponding to the $D_B$ and $D_C$ curve powers. The $D_B$ curve power is determined by a signal representing the base radius $R_B$ (see Eqn. (4) below) and the $D_C$ curve power is determined by a signal representing the angle $\theta$. The $R_B$ and $\Delta$ signals will adjust the location of the cutter tool along the x axis and the location of the tailstock 30 with respect to the pivot or sweep axis PP', by application of appropriate digital signals to the DSCs 48 and 54. The displacements corresponding to $\theta$ and $\Delta$ for each sweep i, for $i=1, \ldots, N$, are applied successively to the DSCs 50 and 54 and set the angle of inclination $\theta$ and the position of the lens 32 along the x' axis, accordingly. The command store 60 initiates the sweeps of the headstock 26 through the DSC 52, the stepper motor 44 and its rotation drive. On subsequent sweeps different values are inputted to the DSCs 50 and 54 to adjust the angle $\theta$ and the location of the lens relative to the cutter unit. Accordingly, with only a few sweeps, the lens 32 can be cut with a minimum of elliptical error.

The system described may also be used for a cutter unit which is mounted on an xy table and which is permitted to rotate thereon about a vertical axis through an angle $\phi$. By using suitable combinations of signals to x,y and $\phi$ stepper motors, the cutter unit may be made to execute sweeps or rotations about the axis PP' geometrically equivalent to the rotations described above. The inclinations $\theta$ are then set by the $\phi$ stepper motor prior to each sweep and the displacements $\Delta$ may be set by the x or y stepper motor prior to each sweep rather than by motion of the tailstock. Translation logic will be needed for each of the x and y stepper motors which drive the table. Such logic is conventionally utilized with xy tables, as are used in plotters and computer aided machine tools. Similar logic is used for the $\phi$ stepper motor.

The digital components illustrated in FIG. 12 may of course be implemented in a computer program of a digital computer to carry out the functions herein described. This computer will have a memory 80 (see FIG. 13) containing the parameters $\theta$ and $\Delta$ for successive sweeps at different combinations of $D_C$ less than $D_B$ for a plus lens and $D_C$ greater than $D_B$ for a minus lens. Only these two cases are needed since the base and cross curves are at 90 degrees to each other, and the lens may simply be rotated 90 degrees to provide the conjugate relationships of $D_B$ to $D_C$. The table values in the memory are generated by a computer 82, preferably off-line, which calculates families of lens surface curves at successive cutter inclinations $\theta$ and outputs successive $\theta$ and $\Delta$ settings appropriate for generating accurate toric surfaces at each of 11 $D_C$ values at each base curve power value $D_B$, 11 of which may also be provided. The manner in which the table is generated will become more apparent from the following discussion in connection with FIGS. 1 through 11.

In FIG. 13 the cutter unit 84 represents the headstock 26, headslide 27 and the cutter wheel unit mounted thereon, together with its drives and stepper motors. The lens unit 86 represents the tailstock 30 and its drive and stepper motor. The computer controller 88 fetches the values from memory as dictated by the input device 90 and performs the interpolation, refractive index correction and cutter wear correction routines, if required. The computer outputs the $\theta$, $\Delta$ and $R_B$ control signals as well as the sweep control signals which command the sweeps.

In order to calculate the actual cross curve cut by a single sweep of the cup tool, and define parameters specifying an appropriate series of sweeps, reference is made now to FIGS. 1 through 11. We shall first describe in detail how a plus curve is calculated; it will become apparent that a minus curve is calculated in a very similar fashion.

Figure 1:
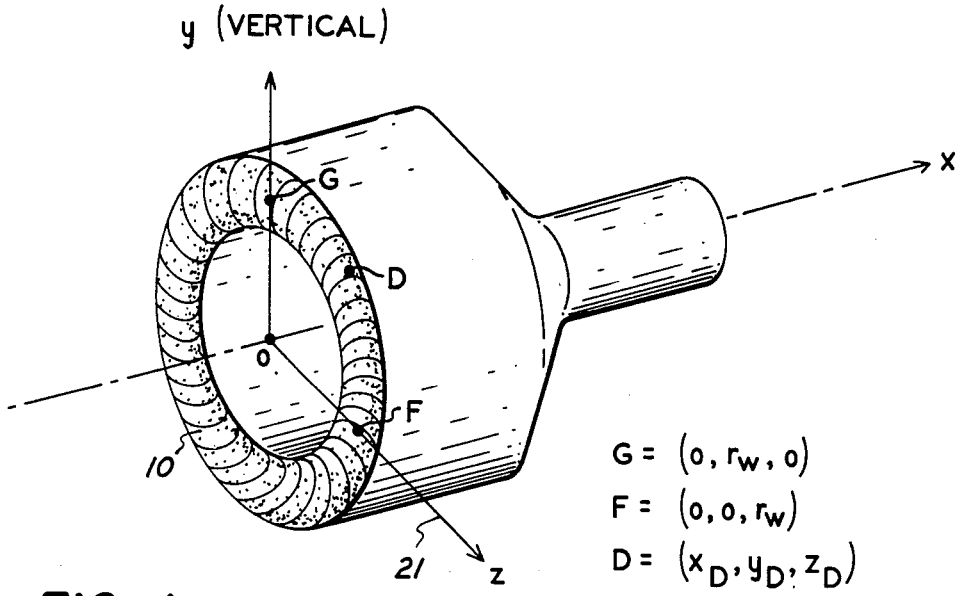
FIG. 1 is a perspective view schematically showing a cup-shaped cutter wheel.

FIG. 1 is a perspective diagram of the cup tool showing a coordinate system Oxyz embedded in the tool. FIG. 1 is schematic and is not drawn to scale. Ox is the axis of spin of the cutter wheel and lies in the horizontal plane. Oy is the vertical axis and passes through the point G. Oz is the other axis in the horizontal plane and passes through the point F. The points F and G both lie on a circle of radius $r_W$, which will be termed the wheel radius, and center O. An exemplary point D on the cutting surface will have coordinates ($x_D$, $y_D$, $z_D$) relative to the coordinate system Oxyz. Consider first how, given $y_D$ and $z_D$, it is possible to calculate $x_D$.

Figure 2:
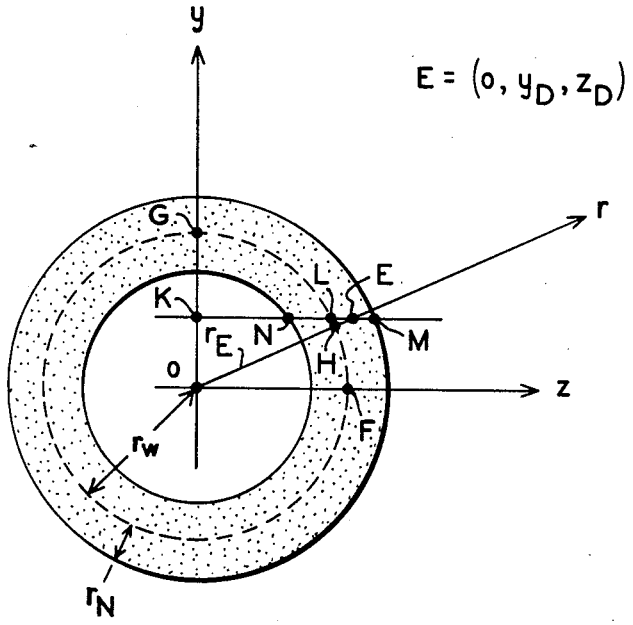
FIG. 2 is a cross-sectional view of the cutter wheel shown in FIG. 1 in the plane $x=0$ which shows the projection E onto this plane of the point shown at D in FIG. 1, the cross hatching being eliminated to clarify the view.

FIG. 2 shows a cross section of the cutter wheel in the plane $x=0$. The point E is the projection of the point D onto the plane $x=0$, and has coordinates (0, $y_D$, $z_D$). The distance $r_D$=*OE is given, by Pythagoras' Theorem, by*

$$r_D^2=y_D^2+z_D^2. \tag{1}$$

Figure 3:
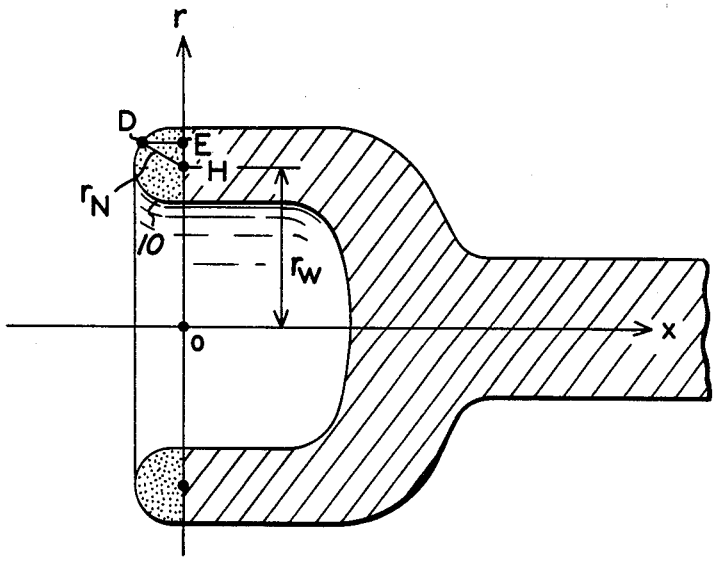
FIG. 3 is a cross-sectional view of the cutter wheel which is diagrammatically illustrated in FIG. 1; the cross section being taken through a plane which includes the point D and the x axis; the cross hatching being removed to clarify the illustration.
Figure 4:
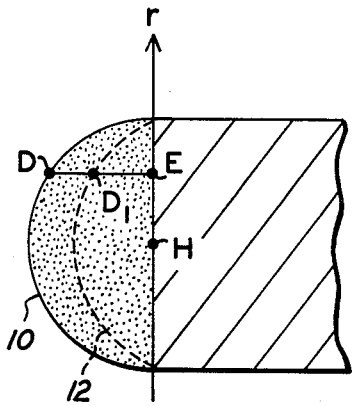
FIG. 4 is an enlarged view of the nose portion of the cutter wheel shown in FIG. 3 which shows additionally possible different shapes of the nose which may be produced due to wearing down thereof.

We now refer to FIG. 3. FIG. 3 shows a cross section of the cutter wheel in the plane containing the horizontal axis Ox and the radial line Or passing through E. The point H lies on the above-mentioned circle of radius $r_W$ which passes through F and G. For purposes of illustration we shall assume that the cross section of the nose 10 is circular with radius $r_N$. Then, applying Pythagoras' Theorem to triangle HDE, and noting that $HD=r_N$, $HE=r_D-r_W$ and $DE=-x_D$, we find $$x_D = -\sqrt{r_N^2-(r_D-r_W)^2}\ . \tag{2}$$

Since $r_N$ and $r_W$ are known dimensions of the cutting tool, Eqns. (1) and (2) allow us to determine $x_D$ if $y_D$ and $z_D$ are known.

It should be noted that this method is not restricted to the nose cross section being circular, as it is possible to determine $x_D$ from $y_D$ and $z_D$ in other cases as well. For example, if the nose were to have a section indicated by the dashed curve 12 of FIG. 4, as might be the case for a worn nose surface, the point D on the cutting surface would be located, instead, at $D_1$. The distance $x_D$ would then be equal to ($-D_1E$). The curve 12 is measured, digitized and stored as a look-up table in a computer memory, thereby giving the distance $D_1E$ as a function of radius $r_D$. Similarly, in some cases the curve can also be approximated as an analytic function such as an ellipse.

The lens surface is generated by a rotation of the cutting tool about a vertical axis, whose intersection with the horizontal plane through the meridian of the lens 32 (FIG. 12), defined by $y=0$, is P, as shown in FIG. 5. FIG. 5 shows a cross section of the tool in this horizontal plane, with the vertical axis positioned relative to the tool in a configuration suitable for generating a plus surface. In FIG. 5, P is positioned in what we shall term the "nominal" position for generating a surface of base and cross radii, $R_B$ and $R_C$ respectively; the line PF is set at an angle $\theta$ to the cutter axis Ox where $$\sin\theta=r_W/(R_C+r_N), \tag{3}$$

and P is taken to be a distance $R_B$ from the nearest point on the cutter, I. When the cutter is rotated about the vertical axis through P, a true circle 14 will be generated in the horizontal plane of radius $PI=R_B$.

For a circular nose cross section centered on F, the points F, I and P lie on a straight line and P is positioned at a distance $R_B+r_N$ from the reference point F. For a non-circular nose cross section, as is exemplified by the dashed line 17 in FIG. 5A, the closest point on line 17 to P is $I_1$. If the point P is set as though the nose is not worn, i.e. with $PI=R_B$, and the nose is worn from curve 15 to curve 17, then the radius $R_B'$ of the curve 16 actually cut will be too large by an amount equal to $PI_1-PI$. If the shape of the worn curve 17 is known, the appropriate adjustment of P (to a very good approximation, displacement along the line PF by a distance $\delta=PP_1=PI_1-PI$ to the point $P_1$) may be made.

The shape of the cross curve (in the vertical plane) will be seen to depend on the angle $\theta$. By using a series of sweeps of the cutter about the vertical axis through P (PP' in FIG. 12) with different but appropriately selected values of $\theta$, a very close approximation to the true cross curve (a circle of radius $R_C$) will be generated. It is found that, in order for benefit to be made from the use of such a series of sweeps, a plus lens should be cut with $R_C>R_B$, as indicated in FIG. 5, and a minus lens should be cut with $R_B>R_C$, as indicated in FIG. 11.

When the cutter is set at an angle $\theta$ as specified by Eqn. (3), the cross curve generated will approximate well the true cross curve (a circle of radius $R_C$) in the vicinity of the center of the lens (i.e. near $y=0$), but will deviate, often markedly, from the true cross curve at large values of y (i.e. near the top and bottom of the lens). This error is often referred to as "elliptical error". (See the patents referred to above). It should be noted that, since the cross-curve power in diopters is given by $$D_C=1000(n-1)/R_C \tag{4}$$

where n is the refractive index and $R_C$ is measured in mm, Eqns. (3) and (4) establish a one-to-one relationship between $D_C$ and $\theta$. It will therefore be understood that when we refer to a cross curve set at some diopter value, the machine will be set to the angle $\theta$ corresponding to this diopter value through Eqns. (3) and (4).

It has been customary to "falsify" the angle $\theta$ by setting, instead, the angle $\theta'$ corresponding to an adjusted cross-curve diopter value $D_C'$, which generally lies between $D_C$ and $D_B$ and is closer to $D_C$ than to $D_B$. This was done in U.S. Pat. No. 3,790,875 using the correction factor f described above. The general effect of this adjustment is to reduce the error near the edge of the lens at the expense of increasing the error near the center of the lens. There is no agreed prescription for obtaining the optimum value of $D_C'$; in fact, for a given lens surface, no single choice of $D_C'$ provides adequate correction of the so-called elliptical error. In accordance with this invention, a series of N sweeps, at different cross curve diopter values $D_{Ci}$ (i=1, . . . , N), will be used. Through Eqns. (3) and (4), these diopter values can be expressed in terms of the corresponding angle values $\theta_i$ or the corresponding radii $R_{Ci}$. In order to demonstrate how these values of $\theta_i$ may be determined, consider first how the cross curve generated with the cutting tool set at an angle $\theta$ as shown in FIG. 5 can be calculated.

Figure 6:
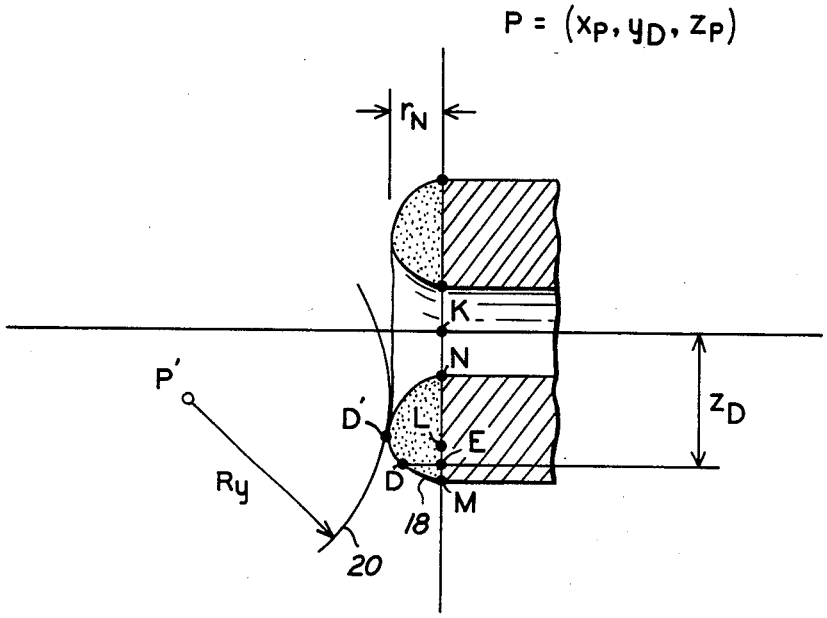
FIG. 6 is a cross-sectional view of the cup-shaped cutting tool in a horizontal plane, $y=y_D$, with the wheel and the vertical rotation or sweep axis positioned with respect to the lens for the generation of a convex or plus lens.

Referring to FIG. 6, a cross section in the horizontal plane at height $y=y_D$ is shown. The intersection of the vertical rotation axis (PP' in FIG. 12) with this plane is the point P', which has coordinates ($x_P$, $y_D$, $z_P$). From FIG. 5 it is seen that $$x_P=-(R_B+r_N)\cos\theta \quad (5)$$

$$z_P=(R_C-R_B)\sin\theta. \quad (6)$$

The curve 20 generated in this plane is a circle of radius P'D' where D' is the point on curve 18 closest to P'. In order to find this distance, points on curve 18 such as D, lying between M and N, are scanned. It is convenient to scan a series of values $z_D$, lying between the distances KN and KM; the unknown coordinate $x_D$ is found from Eqns. (1) and (2), or from Eqn. (1) and a digitized nose cross section, as discussed above. The distance P'D is given from Pythagoras' Theorem by $$(P'D)^2=(x_P-x_D)^2+(z_P-z_D)^2. \quad (7)$$

By scanning sufficient values $z_D$, the distance P'D' can be found to any desired degree of accuracy.

The form of the cross curve generated in the vertical plane containing the axis of rotation (PP') of the cutter wheel and the center of the lens surface R is shown in FIG. 7. Distance P'D' in FIG. 6 is distance $R_y$ in FIG. 7. Curve (a) is the desired circle of radius $R_C$. Vertical and horizontal axes in this plane are indicated as Ry' and Rx' respectively. It should be noted that the primed coordinate system Rx'y'z' is embedded in the lens, while the unprimed coordinate system Oxyz is embedded in the cutter unit and rotates in space during the cutting sweeps (see FIG. 12). Both y and y' measure the height above the horizontal plane y=y'=0. The point S on curve (a) at height $y_D$ is given by $$VS = R_C - \sqrt{R_C^2 - y_D^2} \quad (8)$$

since, by Pythagoras' Theorem applied to triangle UWS, $$UW^2=R_C^2-y_D^2. \quad (9)$$

It is desired that as much glass as possible be removed from the left of curve (a), but without removing any glass from the right of curve (a). The point T on curve (b), namely the curve cut with the tool set at the angle $\theta$ as shown in FIG. 5, is given simply by $VT=R_B-R_y$, where $R_y$=P'D' is the radius of the circle 20 shown in FIG. 6. It is found that curve (b) passes through the point R at y'=0, while for other values of y' the curve (b) lies to the left of curve (a). Glass lying between the curves (a) and (b) needs to be removed.

We have now demonstrated how the cross curve generated for the angle $\theta$ given by Eqn. (3) may be calculated. Using the same procedures we may calculate the cross curves generated at other values of $\theta$. Of particular relevance are curves with angles corresponding to cross curve diopter values DC' which lie between $D_C$ and $D_B$. The curve generated at such a modified angle $\theta'$, which will be greater than $\theta$ for the plus lens under consideration, is shown schematically in FIG. 8 as curve (c). It will be found that, for values of y' below some point $y_2$, the curve (c) lies to the right of curve (a), and that there is a height $y_1$ at which the error (the distance W'W) is a maximum, equal to $\Delta$. The distance $\Delta$ may be calculated to any desired degree of accuracy by calculating the error at a sufficiently large number of heights y' and setting $\Delta$ to be the largest such error. Cutting curve (c) would have the undesirable effect of cutting to the right of the lens surface (curve (a)), to a maximum error depth of $\Delta$, which error would have to be corrected for at a subsequent smoothing stage in the manufacture of the lens. It is easy to see that if a relative displacement between the lens and the cutting assembly is made prior to the sweep at angle $\theta'$, as can easily be effected by withdrawing the lens a distance $\Delta$ along the tailstock slide, the effective cutting curve will be the curve (c'), obtained by translating the curve (c) a distance $\Delta$ to the left in FIG. 8. The curve (c') will touch the correct curve (a) at the height $y_1$, and provide a close approximation to the correct curve (a) in the vicinity of $y_1$.

It will be apparent from FIG. 8 that, whenever a curve is calculated at an angular setting $\theta'$, a corresponding displacement $\Delta'$ is also calculated, so that every calculated curve touches the true curve at (at least) one point but does not cut any glass beyond the true curve. For each of the sweeps defined by $\theta_i$(i=1, . . . , N), the corresponding displacement $\Delta_i$ is found.

The method of selection of the series of sweeps will be apparent from FIG. 9. FIG. 9 gives quantitative examples of the cross curve error as a function of the height y' above the center of the lens, for a lens with $D_B=8$ and $D_C=4$, using three sweeps (curves 1–3). The calculations are performed for a refractive index n=1.523, a wheel radius $r_W$=43 mm, and a nose radius $r_N$=3 mm. In FIG. 9 each curve indicates the error, i.e. the deviation from the true cross curve or equivalently the thickness of glass remaining to be cut, as a function of the distance y' above (or below) the center of the lens. No curve falls below the horizontal axis of the graph (error=0), since the necessary displacements $\Delta_i$ discussed above have been applied. Curve 1, generated by the first sweep, corresponds to the curve (b) of FIG. 7, and is determined by the $\theta$ given by Eqn. (3). Curve 1 has $D_{C1}=4.0$. Curve 3 is next obtained by calculating a number of curves with modified angles $\theta'$ corresponding to values of $D_C'$ between $D_C$ and $D_B$, and selecting from these a curve which gives an acceptably small error (0.06 mm here) at the edge of the lens (35 mm here). Several such curves exist; it is preferable to take the one whose diopter value is closest to $D_C$. The necessary displacement $\Delta_3$ referred to above may be read off the graph at y'=0 as 0.8 mm. Curve 3 is specified by a diopter value $D_{C3}=5.278$. The remaining curve, curve 2, may be obtained by calculating intermediate curves with diopter values $D_C'$ between $D_{C1}$ and $D_{C3}$ until the errors $y_L'$ and $y_R'$ at the intersections with curves 1 and 3 respectively are equal. In this example, curve 2 is specified by a diopter value $D_{C2}=4.610$, and a displacement $\Delta_2=0.18$. The resultant error after three cuts have been performed (in whatever order) with angle settings corresponding to $D_{C1}$, $D_{C2}$ and $D_{C3}$, and displacements $\Delta_1$ (=0), $\Delta_2$ and $\Delta_3$, is shown by the shaded area at the bottom of the figure. For the calculation of $D_{C2}$ and $D_{C3}$ the number of intermediate curves that need to be calculated may be kept to a manageably small number by selecting the iterates $D_C'$ according to the method of repeated bisection. FIG. 14 is a schematic drawing of a convex surface generated by these three cuts 1–3, illustrating how the desired true curve 39 is approximated and showing the glass remaining after the three cuts as the shaded area.

It should be noted that a number of variants on this method can be used with comparable effectiveness. For example, curve 1 could be chosen with $D_{C1}$ a little in excess of 4.0, such that a small (but acceptable) error would occur at y=0. Curve 3 could be selected to have zero error on the edge. Curve 2 could be chosen as having $D_{C2}=(D_{C1}+D_{C3})/2$. A different number of sweeps could be used.

The improved accuracy attainable using three sweeps is evident by comparing the shaded area in FIG. 9 with the area under curve 4. Curve 4 was obtained by calculating a series of curves with different angular settings until one was found with equal errors (0.32 mm) at the center and the edge, and represents about the best that can be done with a single sweep. This curve is given by $D_C'=4.810$. It will be seen that not only is the maximum error (scanning over y') in the three-sweep method 5–6 times less than the smallest maximum error that can be obtained using just one sweep, but also the error is confined to six relatively small regions of the lens, three above the center of the lens and three below. (These regions will appear as ridges on the lens surface.) Furthermore, in much existing practice, use is made of simple formulae for the adjusted cross curve diopter value $D_C'$ which are inadequate to provide even the optimum single sweep.

An example of the use of 5 sweeps is shown in FIG. 10 for the same lens. Here again curve 1 is chosen to be the nominal curve with $D_{C1}=D_C=4.0$. Curve 5 is selected to have zero error at the edge, within a small tolerance, and is specified by $D_{C5}=5.56$. The intermediate curves are selected with uniform diopter spacings: $D_{C2}=4.39$, $D_{C3}=4.78$ and $D_{C4}=5.17$. Note that the vertical scale here has been expanded by a factor of 10 in comparison with FIG. 9. Again the shaded area indicates the resultant error, i.e. glass remaining and needing to be removed.

Whenever a surface is required with different radii of curvature in two orthogonal directions, there are two possible orientations—one with $R_C$ the larger radius, and the other with $R_B$ the larger radius. As stated above, it is found that in order to benefit from multiple sweeps, $R_C$ must be the larger radius for plus lenses and $R_B$ the larger radius for minus lenses. It is found that for the other combinations there is a single optimum curve having zero error at the center and at each of the edges of the lens. This is illustrated for a plus lens with $D_B=4$ and $D_C=8$ (where $R_B>R_C$) as curve 5 in FIG. 9.

The calculation of error curves such as shown in FIGS. 9 and 10 for minus lenses follows an almost identical procedure as we have described for plus lenses. The cutter geometry, and specifically the relative positioning of the cutter and the sweep axis, are illustrated in FIG. 11. The angle $\theta$ is given by $$\sin\theta=r_W/(R_C-r_N), \tag{10}$$

and the vertical rotation axis (PP') passes through the point $P_-$ *whose coordinates are given by*

$$x_{P-}=(R_B-r_N)\cos\theta \tag{11}$$

$$z_{P-}=-(R_B-R_C)\sin\theta. \tag{12}$$

Distances between this axis and points on the nose of the cutter wheel are calculated as for plus lenses. However, the cutting radius at each height $y_D$ is given by the farthest point on the cutter wheel from this axis instead of the nearest point. Adjustments to the relative positions of the lens and the cutter assembly are made as for plus curves to ensure that no glass is cut beyond the exact surface of the lens; in both cases the displacements are in the direction that moves the lens away from the cutter. Exemplary results for a minus surface with $D_B=4$ and $D_C=8$ are given in FIGS. 9A and 15 whose features will be seen to correspond very closely to the features of FIGS. 9 and 14.

From the above discussion it will be apparent that, for both plus and minus lenses and for a given combination of $D_B$ and $D_C$, it is possible to calculate a number N of angular settings $\theta_i$ (i=1, . . . , N) and displacements $\Delta_i$(i=1, . . . , N). In the preferred embodiment described above, N=3, $\theta_1=\theta$ (given by Eqn. (3) for plus lenses or Eqn. (10) for minus lenses), and $\Delta_1=0$ (since the first curve does not need to be shifted); the two additional sweeps are therefore determined by the four parameters $\theta_2$, $\theta_3$, $\Delta_2$, and $\Delta_3$.

The computation of these parameters can be performed for each lens by a computer attached to the lens-generating machine, but in practice this could be prohibitively slow, particularly if it is desired to use a small (and cost-effective) computer. A convenient implementation is therefore to precalculate tables of the parameters $\theta_i$ and $\Delta_i$ on a two-dimensional grid of diopter values ($D_B$, $D_C$) covering the range desired. For example, each of $D_B$ and $D_C$ might range from 1.0 to 11.0 in intervals of 1 diopter. Parameters stored at points on this grid with $D_B>D_C$ correspond to plus lenses and parameters stored with $D_C>D_B$ correspond to minus lenses. The tables are stored in a Programmable Read-Only Memory (PROM) in a microprocessor controlling the lens-generating machine, and standard interpolation techniques (e.g. bilinear interpolation) are then used to interpolate the appropriate parameters for the lens surface being ground, as explained above in connection with FIGS. 12 and 13.

Straightforward modifications to the above implementation may be made to correct for a worn or non-circular nose cross section. Provided that this cross section is known, e.g. through a digitization of the curve 12 of FIG. 4, tables of $\theta_i$ and $\Delta_i$(i=1, . . . , N) may be calculated as indicated above. For good accuracy it may be desirable to store $\theta_1$ and $\Delta_1$ as well as the other $\theta_i$ and $\Delta_i$. It is also desirable to store the adjustment $\delta_i=PP_1$ to the distance between the reference point F on the cutter wheel and the vertical rotation axis (PP') necessary to avoid the introduction of an error in the base radius, as discussed above with reference to FIG. 5A. It may, however, be impractical to re-program the microprocessor controlling the lens-generating machine periodically during the life of the cutter. One practical way to compensate for cutter wear is to store two sets of tables in the PROM, one for a true nose cross section and one for a representative well-worn cross section. The microprocessor may calculate the parameters $\theta_i$, $\Delta_i$ and $\delta_i$ from each set of tables, and take a weighted average of each of these parameters dependent on the estimated degree of wear which may be periodically set into the microprocessor by the operator.

Finally, it will be noted that, in order to calculate the machine settings for particular values of $D_B$ and $D_C$, the refractive index needs to be known (see Eqn. (4)). Rather than store one set of tables for each refractive index, it is preferable to store a single set of tables for a reference refractive index $n_0$ (e.g. 1.523); then, when specified diopter values are desired for a lens material of a different refractive index, $n_1$ say, these specified diopter values are first subject to an elementary adjustment, namely multiplication by the factor $(n_0-1)/(n_1-1)$, before making use of the tables.

From the foregoing description it will be apparent that there have been provided improvements in toric lens generating and specifically in methods and apparatus whereby toric lenses and toric surfaces may be cut or generated with minimal elliptical error in their cross curves. Variations and modifications in the herein described methods and apparatus, within the scope of the invention, will undoubtedly suggest themselves to those skilled in the art. Accordingly the foregoing description should be taken as illustrative and not in a limiting sense.

I claim:

1. The method of generating toric surfaces having base and cross curvatures of different radius with the aid of a cutter unit having a cutter wheel which sweeps about an axis perpendicular to the axis of the lens, which comprises the steps of sweeping said cutter wheel about said perpendicular axis a plurality of times to make a plurality of cuts, changing the location of said cutter wheel with respect to said surface being generated prior to each cut after the first of said cuts to reduce the elliptical error in different portions of said cross curve during each of said subsequent cuts whereby to provide a toric surface in which the elliptical error is minimized wherein said location changing step is carried out by changing the angle at which said wheel is inclined to produce cross curves of different powers in a lens desired to have said toric surface, and separating said cutter wheel and said lens on each subsequent cut to prevent increasing the error in the cross curve in any portion thereof which is cut during a preceding one of said plurality of cuts.

2. The method according to claim 1 wherein said cutter wheel is cup shaped and has a cutting nose the center of the cross section of which, in a plane through the meridian of the base curve, is disposed along a first line through said perpendicular axis of rotation, said wheel being rotatable about a spindle axis through the center of said wheel, said angle being between said first line and said spindle axis, said angle changing step being carried out by varying said angle, and said separating step being carried out by displacing said wheel and said lens from each other along the axis of said lens.

3. The method according to claim 2 wherein a first of said cuts is carried out with said cutter at said inclination angle $\theta$, to produce a cross curve with minimum elliptical error on the surface of the lens in the vicinity of the lens axis, and subsequent ones of said cuts are carried out with said angle $\theta$ and with said cutter at said displacements which provide ridges on said toric surface at successive distances from the center of said lens where the elliptical error is approximately equal.

4. The method according to claim 2 wherein a second of said cuts is carried out with said angle $\theta$ and displacement to reduce the elliptical error in a portion of said cross curve near the edge of said lens, and a third of said cuts is carried out with said angle $\theta$ and displacement to reduce said elliptical error in another portion of said cross curve between the center and said portion near the edge of said lens where said error is reduced on said second cut.

5. In apparatus for generating a toric surface on a lens which apparatus has a cutter wheel which sweeps about an axis perpendicular to the axis of the lens while rotating with respect to said lens, a system for minimizing elliptical error in the cross curve of said lens which comprises means for sweeping said cutter wheel about said perpendicular axis a plurality of times to make a plurality of cuts in said lens, and means for changing the location of said cutter wheel with respect to said lens prior to each cut after the first of said cuts to reduce the elliptical error in different portions of said cross curve during each said subsequent cut whereby to provide a toric surface in which the elliptical error is minimized wherein said means for changing said location comprises means for changing the angle $\theta$ at which said wheel is inclined to produce cross curves of different powers, and means for separating said cutter wheel and said lens on each said subsequent cut to prevent increasing the error in any portion of the cross curve which is cut during the preceding ones of said plurality of cuts.

6. The system according to claim 5 wherein said cutter wheel is cup shaped and has a cutting nose the center of the cross section of which, in a plane through the meridian of the base curve of said lens, is disposed along a first line through said perpendicular axis of rotation, and wherein said angle 74 is between said first line and said wheel axis, and said angle changing means comprises means for changing said angle and said separating means comprises means for displacing said wheel and said lens with respect to each other along the axis of said lens.

7. The system according to claim 6 wherein said angle varying means includes means operative to change said inclination angle $\theta$ and said separating means is operative to set said displacements to produce a cross curve with minimal elliptical error on the toric surface of said lens in the vicinity of the meridian of the base curve of said lens and operative to change said angle $\theta$ on subsequent ones of said cuts with said angle $\theta$ and said cutter at said displacements which provide ridges upon said toric surface at successive distances from the center meridian of said lens where the elliptical error is approximately equal.

8. The system according to claim 6 wherein said angle varying means is operative to set said angle and said separating means is operative to set said displacements to reduce the elliptical error in a portion of said curve near the edge of said lens in a second of said cuts and to reduce the elliptical error in another portion of said cross curve between the center of said lens and said portion near the edge thereof in a third of said cuts.

9. Apparatus for controlling a toric lens grinding machine having a cutter wheel unit with a cup-shaped cutter wheel and means for sweeping said unit about an axis perpendicular to the axis of the lens being ground to define the base curve of the lens and means for orienting the axis of said wheel to define the cross curve of said lens, which apparatus comprises memory means for storing a table of values of angles of orientation of said cutter wheel and displacements of said wheel from said lens along the optical axis of said lens for a plurality of different cross curves of a plurality of powers $D_C$ for each of a plurality of base curves of different powers $D_B$, and computer controller means for controlling said orienting means in accordance with different ones of said values during successive ones of said sweeps across the said lens whereby to simultaneously grind the base and cross curves with minimal elliptical error in said cross curve.

10. The apparatus according to claim 9 wherein said computer controller means includes means for interpolating between different sets of said values to derive orientations and displacements to set said orienting means for the grinding of cross curves of powers intermediate to said plurality of powers.

11. The apparatus according to claim 9 wherein said computer controlling means includes means for correcting said values stored in said memory for lens material of different refractive index.

12. The apparatus according to claim 9 wherein said computer controller means includes means for correcting said values stored in said memory for wear of the nose of said cup-shaped cutter wheel.

* * * * *